United States Patent [19]

Siman

[11] Patent Number: 4,599,594

[45] Date of Patent: Jul. 8, 1986

[54] ELECTRICAL INDUCTIVE APPARATUS

[75] Inventor: Jaime E. Siman, Watkinsville, Ga.

[73] Assignee: Westinghouse Electric Corp., Pittsburgh, Pa.

[21] Appl. No.: 699,372

[22] Filed: Feb. 7, 1985

[51] Int. Cl.[4] ..... H01F 27/02; H01F 27/30

[52] U.S. Cl. ..... 336/92; 336/198; 336/213

[58] Field of Search ..... 336/92, 198, 208, 213, 336/65, 196

[56] References Cited

U.S. PATENT DOCUMENTS

| | | | |
|---|---|---|---|
| 3,112,898 | 12/1963 | Stahl | 336/198 X |
| 4,083,026 | 4/1978 | Kleen et al. | 336/92 X |
| 4,227,120 | 10/1980 | Luborsky | 336/213 X |
| 4,238,753 | 12/1980 | Bayer | 336/198 X |
| 4,325,045 | 4/1982 | Mehl | 336/213 X |
| 4,347,490 | 8/1982 | Peterson | 336/198 X |
| 4,458,575 | 7/1984 | Geissler et al. | 336/196 X |

FOREIGN PATENT DOCUMENTS

| | | | |
|---|---|---|---|
| 2262387 | 9/1975 | France | 336/198 |

*Primary Examiner*—Thomas J. Kozma
*Attorney, Agent, or Firm*—D. R. Lackey

[57] ABSTRACT

Electrical inductive apparatus, such as a transformer, having a core-coil assembly disposed in a tank. The magnetic core of the core-coil assembly includes amorphous metal, and is of the wound, rectangular, jointless construction. A protective and insulative winding tube is disposed about a winding leg of the magnetic core, and an electrical winding is disposed about the winding tube. The winding tube and tank cooperatively support the weight of the electrical winding.

10 Claims, 9 Drawing Figures

ELECTRICAL INDUCTIVE APPARATUS

BACKGROUND OF THE INVENTION

1. Field of the Invention

The invention relates in general to electrical inductive apparatus, such as transformers, and more specifically to electrical inductive apparatus having a magnetic core containing amorphous metal.

2. Description of the Prior Art

The core losses in the electrical transformers used by electric utility companies represents a significant loss of the energy generated, even though transformers are highly efficient. With the increasing value of energy, ways of reducing these loses are being sought. The use of amorphous metal in the magnetic cores of distribution and power transformers appears to be attractive, because, at equivalent inductions, the core losses of electrical grade amorphous metals are only 25% to 35% of the losses of conventional grain-oriented electrical steels.

Amorphous metals, however, in addition to their higher initial cost than conventional electrical steels, also pose many manufacturing problems not associated with conventional steels. For example, amorphous metal is very thin, being only about 1 to 1½ mils thick, and it is very brittle, especially after anneal. Thus, with the wound magnetic cores conventionally used with distribution transformers, the core joint becomes a problem, making the use of a jointless magnetic core very attractive. This means that the primary and secondary windings of the transformer must be wound about the legs of a closed loop magnetic core. In order to utilize windings which are similar to those presently used in distribution transformers, the wound core would have to be wound and annealed in a rectangular configuration. This leads to another disadvantage of amorphous metals. The magnetic core, after winding, cannot support itself. It will collapse and close the window if oriented with the window axis horizontal. Amorphous metal is also very stress sensitive. Any pressure on the magnetic core, or change in its configuration after annealing, will increase its losses.

My concurrently filed application Ser. No. 699,378, filed Feb. 7, 1985, entitled "A Magnetic Core and Methods of Constructing Same", is directed to methods and coatings for making an amorphous core self-supporting, as well as to contain amorphous flakes and particles which may be associated with the core due to its brittleness. This copending patent application discloses the use of fiberglass reinforced composite coatings of low stress and high-strength resins, bonded to the flat, exposed lamination edges of a wound, unjointed magnetic core.

Making an amorphous magnetic core self-supporting, however, solves only part of the problem. Care must be taken not to exert stresses on the magnetic core during the coil winding process, during which the primary and secondary windings are wound directly on the winding legs of the magnetic core. Care must also be taken not to exert stresses on the magnetic core when it is immersed in a liquid-filled transformer tank and operated over many years of service.

SUMMARY OF THE INVENTION

Briefly, the present invention relates to a new and improved electrical inductive apparatus, such as transformers and electrical reactors, and more specifically to electrical transformers of the distribution core-form type which have a wound, rectangular, jointless magnetic core. The magnetic core, at least a portion of which includes amorphous metal, has a plurality of closely adjacent lamination turns configured to define winding leg and yoke portions disposed about a rectangular core window. The magnetic core is consolidated to make it self-supporting and a winding tube is constructed about each winding leg. The winding tube is constructed to withstand forces applied thereto during the coil winding process, without transmitting deleterious forces into the magnetic core. In certain embodiments, the winding tube includes portions for receiving the plates which hold the core while the coil windings are being formed. The resulting core-coil assembly is disposed in a transformer tank with the longitudinal axes of the winding legs vertically oriented. The winding tubes and tank cooperatively support the coil weight, preventing the magnetic core from being stressed by the coil windings during the operation of the transformer throughout its normal operating temperature range.

BRIEF DESCRIPTION OF THE DRAWINGS

The invention may be better understood and further advantages and uses thereof more readily apparent when considered in view of the following detailed description of exemplary embodiments, taken with the accompanying drawings in which.

DESCRIPTION OF THE PREFERRED EMBODIMENTS

Figure 1:
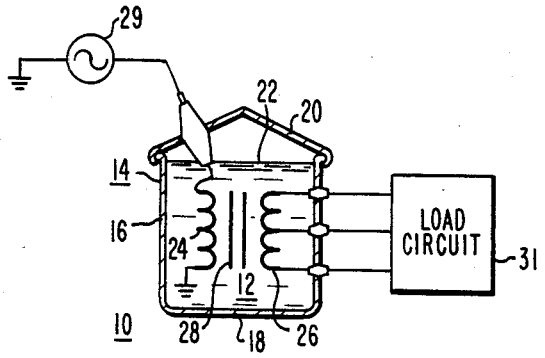
FIG. 1 is a partially schematic diagram of electrical inductive apparatus which may be constructed according to the teachings of the invention.

Referring now to the drawings, and to FIG. 1 in particular, there is shown an electrical transformer 10 of the distribution type, which may be constructed according to the teachings of the invention. Transformer 10 includes a core-coil assembly 12 disposed in a tank 14 having side wall, bottom and cover portions 16, 18 and 20, respectively. The core-coil assembly 12 is immersed in a liquid cooling dielectric 22, such as mineral oil. The coil portion of assembly 12 includes primary and secondary windings 24 and 26, respectively, which are disposed in inductive relation with a magnetic core 28. The primary winding 24 is adapted for connection to a source 29 of electrical potential, and the secondary winding 26 is adapted for connection to a load circuit 31.

Figure 2:
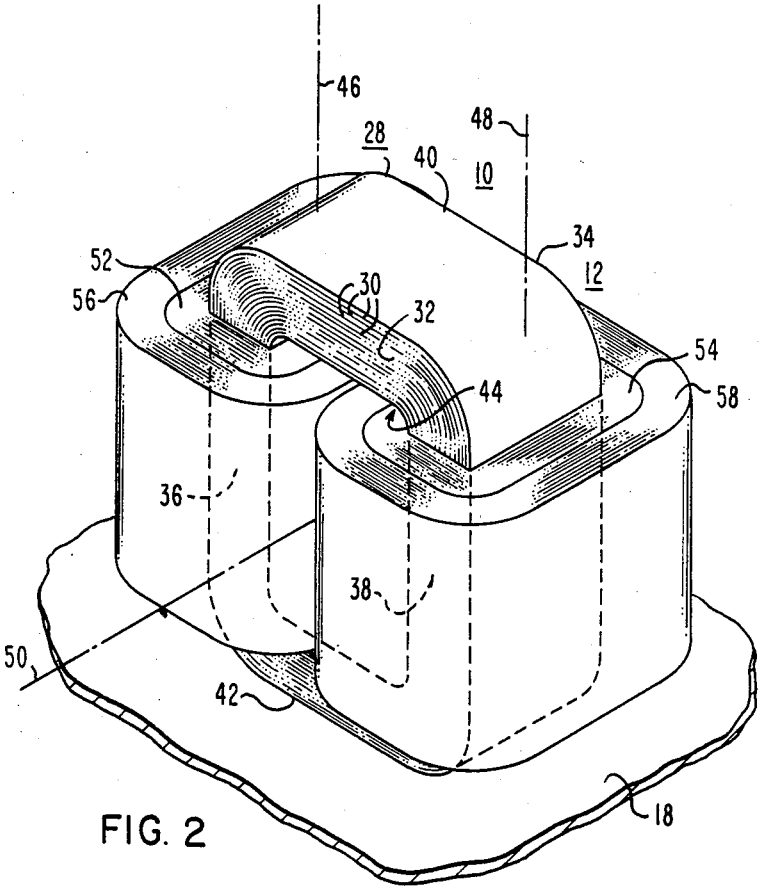
FIG. 2 is a perspective view of a core-coil assembly of core-form construction, which may be constructed according to the teachings of the invention.

As shown in FIG. 2, which is a perspective view of a core-form embodiment of the core-coil assembly 12 shown schematically in FIG. 1, the magnetic core is formed of a thin elongated sheet of ferromagnetic material which is wound to provide a plurality of closely adjacent lamination turns 30. The closely adjacent edges of the lamination turns 30 collectively form first and second flat opposite ends of sides 32 and 34, respectively, of magnetic core 28. The lamination turns 30 also each define a substantially rectangular configuration which collectively form first and second spaced, parallel, winding leg portions 36 and 38, respectively, joined by upper and lower yoke portions 40 and 42, respectively. The winding leg and yoke portions create an opening or core window 44. In the preferred operating position of the core-coil assembly 12, the magnetic core 28 is oriented with the longitudinal axes 46 and 48 of the winding legs 36 and 38, respectively, orthogonal to the tank bottom 18, which results in the center line 50 of window 44 being horizontally disposed. In the usual rectangular core-form construction, the primary and secondary windings 24 and 26 are divided into electrically interconnected sections, such as sections 52 and 54 of the primary winding 24, and sections 56 and 58 of the secondary winding 26. Sections 52 and 56 are concentrically disposed on winding leg 36, and sections 54 and 58 are concentrically disposed on winding leg 38.

When magnetic core 28 contains amorphous metal, such as Allied Corporation's 2605SC, the core is preferably unjointed, and thus winding sections 52 and 56 would be wound directly on leg 36, and winding sections 54 and 58 would be wound directly on leg 38. Prior to such a winding operation, the magnetic core 28 would be wound on a mandrel having a rectangularly-shaped male portion, and it would be annealed to optimize its magnetic properties while maintained in the as-wound rectangular configuration.

After anneal, the as-wound configuration is maintained while the magnetic core is consolidated to make it self-supporting. This is preferably done according to the teachings of my hereinbefore mentioned co-pending application Ser. No. 699,378, and this application is hereby incorporated into the specification of the present application by reference. As shown pictorially in FIG. 3, this copending application teaches the formation of a composite coating 60 on the edges of the lamination turns which define the first and second flat ends or sides 32 and 34 of the magnetic core 28. Coating 60 holds the dimensions and configuration of magnetic core 28 without deleteriously stressing the core material. My copending application also describes how a basically amorphous core may include some lamination turns formed of a non-amorphous material, such as a predetermined number of inner and outer lamination turns, for the purpose of protecting the core edges, and also to help prevent amorphous flakes from being liberated into the coolant 22. The non-amorphous material may be conventional grain-oriented electrical steel.

Figure 3:
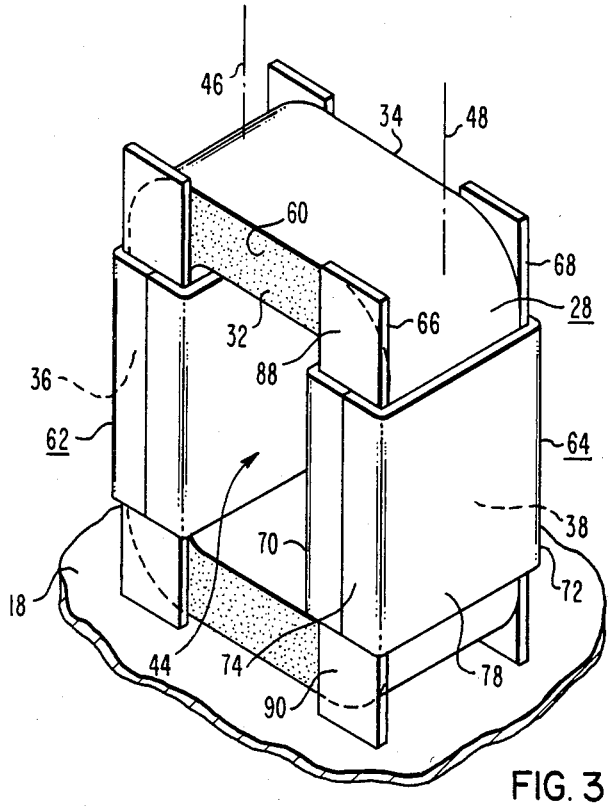
FIG. 3 is a perspective view of the core shown in FIG. 2, consolidated and protected against coil winding and operating stresses according to the teachings of the invention.

FIG. 3 additionally shows winding tubes 62 and 64 constructed according to the teachings of the invention, which are disposed about winding legs 36 and 38, respectively. Since winding tubes 62 and 64 are each of like construction, only winding tube 64 will be described in detail. In describing winding tube 64, FIG. 4 will also be referred to, which illustrates an exploded, perspective view of winding tube 64.

More specifically, winding tube 64 includes first and second similar I-plate members 66 and 68, respectively, and first and second similar U-shaped members 70 and 72, respectively. Members 66, 68, 70 and 72 are formed of electrically insulative materials selected for their electrical and mechanical strengths in a transformer operating environment. The two different profiles of the winding tube members may be extruded, filament wound, or pultruded, for example, in relatively long sections, with the members 66, 68, 70 and 72 simply being cut to length from such a section. When using fiberglass reinforced polyester formed by pultrusion such as grade GP-01, for example, the members may be 0.125 inch (3.17 mm) thick for a typical 25 kva distribution transformer. Other reinforced plastic materials may be used, as long as they have the requisite electrical and mechanical strength, and are thermally and chemically compatible with the transformer environment.

The U-shaped members, such as U-member 72, includes first and second spaced, parallel leg portions 74 and 76, respectively, joined by bight portion 78. The dimension 80 between leg portions 74 and 76 is selected according to the thickness of the core 28 between its flat surfaces or ends 32 and 34. The length dimension 82 of legs 74 and 76 may be standard, and is preferably selected such that the ends of the legs of member 70 just butt the ends of the legs of member 72, on the smallest magnetic core which members 70 and 72 are to be used with. On larger magnetic cores, the facing ends of the legs will be spaced apart.

It is important to assemble winding tubes 62 and 64, and to fix their members securely together, such that the resulting tube forms a high strength box about its associated winding leg which will withstand the forces associated with coil winding, without transferring these forces to the magnetic core. Such forces are directed radially inward, and they attempt to crush the winding tube. Width dimension 83 of the I-plates 66 and 68 is selected to prevent the U-shaped members 70 and 72 from being forced against the magnetic core during coil winding.

Not only must the winding tubes 62 and 64 absorb these winding induced forces without damage, while protecting the core legs from stress, but the winding tubes must be constructed to allow relative movement between the magnetic core 28 and the winding tubes 62 and 64 after the electrical windings have been formed. This relative movement should be in a direction parallel with the winding leg axes 46 and 48. The correct selection of width dimension 83 of the I-plate members 66 and 68 also assures this result.

Figure 4:
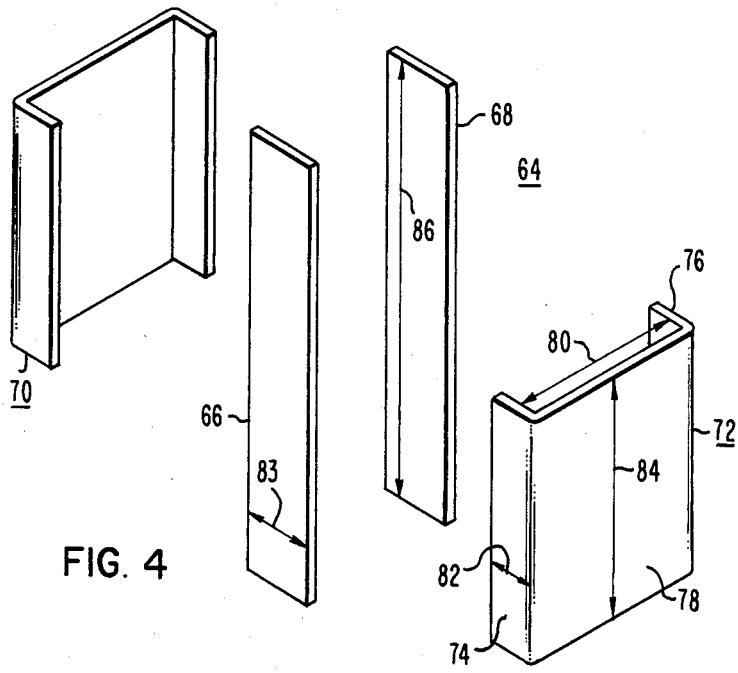
FIG. 4 is an exploded, perspective view of one of the winding tubes shown assembled in FIG. 3.

As clearly shown in FIGS. 3 and 4, each of the U-shaped members 70 and 72 is cut to a length 84 which will snugly fill the height dimension of the core window 44, while the I-shaped members 66 and 68 are cut to a length 86 which is substantially the same as the height of core 28 when it is oriented as shown in FIG. 3. This creates flat extensions of the I-plate members 66 and 68 above and below the U-shaped members 70 and 72, such as extensions 88 and 90 on the I-plate 66. These extensions lie flat against the flat end surfaces 32 and 34 of magnetic core 28, and provide surfaces for clamping the core 28 while the winding sections are being wound about the core winding legs. These extensions, such as extension 90 on I-plate 66, also provide "feet" which cooperate with the tank 14, i.e., the tank bottom 18 in the disclosed embodiment, to support the weight of the windings which will be subsequently formed on the winding tubes 62 and 64. Thus, the windings are fixed to the winding tubes 62 and 64, but the winding tubes are not fixed to the core legs 36 and 38. The slight vertical relative movement, allowable by the disclosed construction, enables the magnetic core 28 and the winding tubes 62 and 64 to be self-adjusting relative to their common support, i.e., the tank bottom 18, assuring that no stresses will be induced into magnetic core 28 due to the weight of the winding sections 52, 54, 56 and 58.

The various members of the winding tubes 62 and 64, when constructed of a thermosettable, reinforced resin, such as a polyester, phenolic or epoxy resin, may be easily glued together using a compatible adhesive. For example, an epoxy adhesive, such as 3M's Scotch-weld ® No. 2216B/A, may be used. In order to assure excellent adhesive bonds, grit blasting may be used to roughen the surfaces which are to be adhesively joined.

Figure 5:
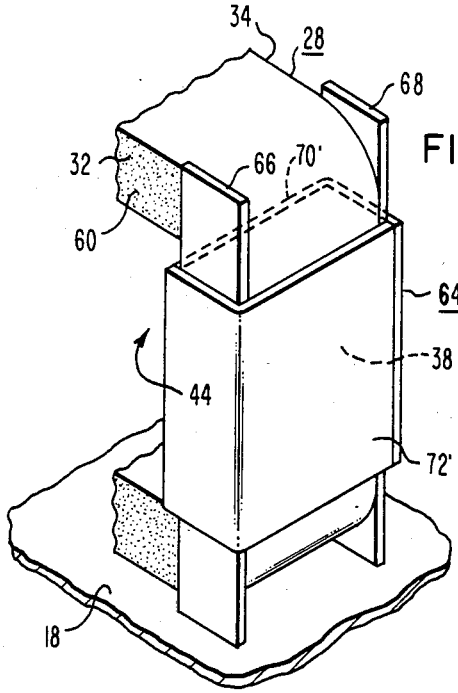
FIG. 5 is a fragmentary, perspective view of the core shown in FIG. 2, consolidated and stress protected according to another embodiment of the invention.
Figure 6:
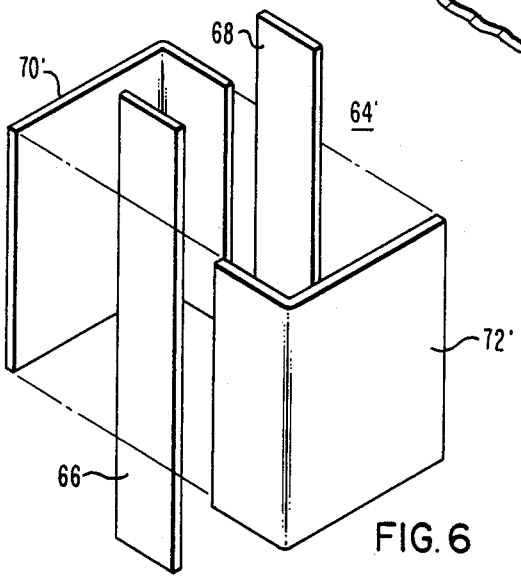
FIG. 6 is an exploded, perspective view of the winding tube shown assembled in FIG. 5.

FIG. 5 is a fragmentary view which is similar to FIG. 3, except illustrating a winding tube 64' which utilizes I-plates 66 and 68 similar to the FIG. 3 embodiment, but it uses angular members 70' and 72' which are L-shaped, instead of U-shaped. FIG. 6 is an exploded, perspective view of winding tube 64'. Similar to the FIG. 3 embodiment, the elements of winding tube 64' are adhesively joined together, using an adhesive compatible with the materials used to construct the members of the winding tube. The adhesive must also be compatible with the liquid dielectric and operating temperature of the transformer environment.

Figure 7:
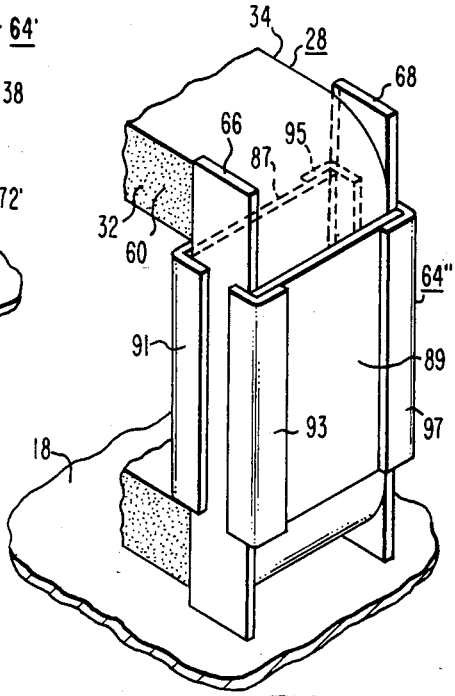
FIG. 7 is a fragmentary, perspective view of the core shown in FIG. 2, consolidated and stress protected according to another embodiment of the invention.

FIG. 7 is a fragmentary view similar to FIG. 5, except illustrating a winding tube 64'' which utilizes I-plate members 66 and 68 similar to the embodiments of FIGS. 3 and 5. Two I-plates 87 and 89 and four right angle corner members 91, 93, 95 and 97 are also required, and thus this embodiment is not as attractive as the embodiments which require fewer elements to be adhesively joined.

It is also practical to eliminate the need for adhesive joining by using a suitable thermoplastic material, instead of a thermosettable material, to construct the winding tube. When thermoplastic materials are utilized, contacting portions of the winding tube members may be fused together, such as by an ultrasonically-induced fusion, i.e., ultrasonic welding. The thermoplastic material selected must have excellent electrical insulative properties, and it must be dimensionally stable, maintaining its mechanical strength in the hot liquid dielectric of a distribution transformer. Examples of suitable engineering thermoplastic materials include polybuthylene terephthalate (PBT), polyarylate (aromatic polyester), polyamide imide (PAI), polyphenylene sulfide (PPS), polysulfone (PSO), and polyphenylene oxide (PPO), all of which can be reinforced, such as with glass fiber.

Figure 8:
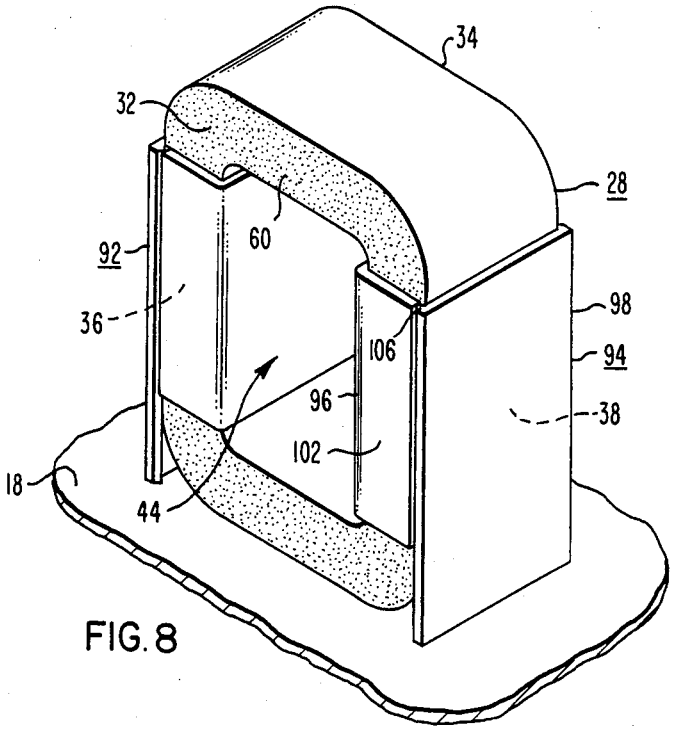
FIG. 8 is a perspective view of the core shown in FIG. 2, consolidated and stress protected according to still another embodiment of the invention.
Figure 9:
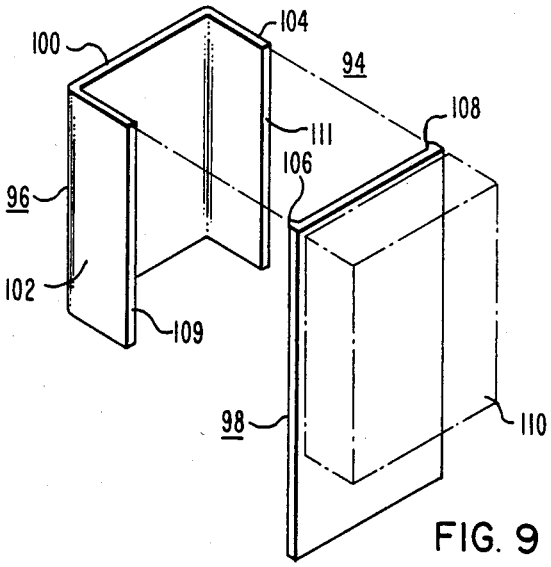
FIG. 9 is an exploded perspective view of one of the winding tubes shown assembled in FIG. 8, with an ultrasonic transducer for welding the components together being shown in phantom.

FIG. 8 is a view of magnetic core 28 which is similar to FIG. 3, except including winding tubes 92 and 94 on winding legs 36 and 38, respectively. FIG. 9 is an exploded, perspective view of winding tube 94. Winding tubes 92 and 94 are constructed to facilitate the use of ultrasonic energy to join the elements of the winding tube. Only two elements are required to construct each winding tube in the embodiment shown in FIGS. 8 and 9, and the areas to be fused may be easily accessed by an ultrasonic transducer. Further, the cross-sectional configurations of the two basic configurations are easily extruded in long lengths and simply cut to length. Since each winding tube is of like construction, only winding tube 94 will be described in detail. The exploded, perspective view of winding tube 94 shown in FIG. 9 will also be referred to.

More specifically, winding tube 94 includes first and second members 96 and 98, respectively, with the first member 96 being U-shaped in cross section, having a bight 100 and first and second spaced, parallel leg portions 102 and 104. The second member 98 is substantially I-shaped except for a pair of energy focusing projections 106 and 108 which project outwardly from a common side of the I-shaped member. Projections 106 and 108 are spaced to contact the end surfaces 109 and 111, respectively, of leg portions 102 and 104. Leg portions 102 and 104 are spaced according to the core width dimension between flat end surfaces 32 and 34, and it is inserted into the core window 44 such that its leg portions 102 and 104 are closely adjacent to flat end surfaces 32 and 34, respectively. The length of the leg portions 102 and 104 is selected according to the width of a winding leg measured across its flat end surfaces 32 or 34. In other words, when the I-shaped member 98 is assembled with the U-shaped member 96, the focusing extensions 106 and 108 on member 98 should contact end surfaces 109 and 111, respectively, of member 96. Further, after members 96 and 98 have been joined with an ultrasonically-induced fusion of their contacting surfaces, the winding tube should snugly encompass the winding leg 38 while still permitting independent self-adjustment of core 28 and winding tubes 92 and 94, relative to their supports, which is the tank bottom 18 in the example. An ultrasonic transducer 110 is shown in phantom in FIG. 9, in position to ultrasonically weld projections 106 and 108 to end surfaces 109 and 111, respectively.

In summary, there has been disclosed new and improved electrical inductive apparatus having a core-coil assembly which includes amorphous metal in the magnetic core. The core-coil assembly is of the rectangular, core-form construction, having winding assemblies disposed on spaced leg portions of a wound, uncut magnetic core. The magnetic core is consolidated to make it self-supporting, and winding tubes are constructed about each winding leg. Each winding tube performs several functions. It is capable of forming the complete electrical insulation between the adjacent electrical winding and the magnetic core, it forms a structural box around the winding leg which absorbs the coil winding stresses created while the winding sections of the coil are being wound on the winding tube, and it cooperates with the tank, i.e., the tank bottom in the example, to support the weight of the associated winding sections, without transferring the weight to the stress sensitive magnetic core.

I claim as my invention:

1. Electrical inductive apparatus, comprising:

a tank having a bottom portion, a magnetic core containing amorphous metal, said magnetic core having winding leg and yoke portions which define a window, means consolidating said magnetic core to make it self-supporting, said magnetic core being disposed in said tank with the longitudinal axes of said winding leg portions vertically oriented with respect to the bottom portion of the tank, a flangeless, electrically insulative winding tube disposed about a winding leg portion, said flangeless winding tube being constructed of members which are assembled about the winding leg and fixed to one another to form a protective box about the winding leg which withstands inwardly directed radial forces without introducing stresses into said magnetic core, the members of said flangeless winding tube having only first and second different extrudable profiles cuttable to length according to predetermined dimensions of said magnetic core, and an electrical winding disposed about and fixed to said flangeless winding tube, said flangeless winding tube and tank cooperatively supporting the weight of said electrical winding, to prevent the weight of said electrical winding from introducing mechanical strains into said magnetic core.

2. The electrical inductive apparatus of claim 1 wherein one of the members of one of the first and second extrudable profiles has a length dimension selected to extend to the bottom portion of the tank, to support the flangeless winding tube and electrical winding.

3. The electrical inductive apparatus of claim 1 wherein the tank includes a liquid dielectric, with the magnetic core, winding tube and electrical winding being immersed therein, and wherein the bottom portion of the tank independently supports the magnetic core and the winding tube, and wherein the winding tube and magnetic core are free to move relative to one another, in a direction parallel with the axes of the winding leg portion of the magnetic core, at least to an extent that the magnetic core and winding tube are self-adjusting relative to the bottom portion of the tank.

4. The electrical inductive apparatus of claim 1 wherein the magnetic core includes a plurality of closely adjacent lamination turns, the exposed edges of which collectively define first and second major, flat vertically oriented surfaces of the magnetic core, and wherein the first and second basic extrudable profiles of the winding tube are defined by I-shaped members and angular members, respectively, and including first and second of said I-shaped members disposed on opposite sides of the winding leg portion, against said first and second flat surfaces, respectively, of the magnetic core, and first and second of said angular members assembled about the winding leg and said I-shaped members, said first and second angular members having leg portions fixed to predetermined ones of said I-shaped members.

5. The electrical inductive apparatus of claim 4 wherein the first and second angular members are substantially L-shaped, with each having a first leg portion fixed to a different I-shaped member, and a second leg portion fixed to the first leg portion of the other angular member.

6. The electrical inductive apparatus of claim 4 wherein the first and second angular members are substantially U-shaped, with each having first and second leg portions respectively fixed to the first and second I-shaped members.

7. The electrical inductive apparatus of claim 4 wherein the length dimension of the first and second I-shaped members is selected to provide flat surfaces above and below the electrical winding, and such that the first and second I-shaped members extend to the bottom portion of the tank to provide support for the winding tube and electrical winding.

8. The electrical inductive apparatus of claim 1 wherein the magnetic core includes a plurality of closely adjacent lamination turns, with the outermost lamination turn defining a major, smooth, vertically oriented surface of a winding leg portion, and with the adjacent edges of the lamination turns collectively defining first and second major, flat vertically oriented surfaces of the winding leg, and wherein the first and second extrudable profiles of the winding tube are defined by I-shaped and U-shaped members, respectively, and including an I-shaped member disposed against the major, smooth, vertically oriented surface of the winding leg, and a U-shaped member having a bight portion disposed through the core window and first and second leg portions which extend along the first and second major, flat, vertically oriented surfaces of the winding leg and abut the I-shaped member, and including means fixing the ends of said first and second leg portions to said I-shaped member.

9. The electrical inductive apparatus of claim 8 wherein the I- and U-shaped members of the winding tube are each formed of an engineering thermoplastic material, with the means joining the ends of the U-shaped member to the I-shaped member including an ultrasonically-induced fusion of the abutting thermoplastic materials.

10. The electrical inductive apparatus of claim 9 wherein the I-shaped member is dimensioned to extend to the bottom portion of the tank, to support the flangeless winding tube and electrical winding.

* * * * *